US007758281B2

(12) United States Patent
Knox

(10) Patent No.: US 7,758,281 B2
(45) Date of Patent: Jul. 20, 2010

(54) SYNTHETIC SPORTS TURF HAVING IMPROVED PLAYABILITY AND WEARABILITY

(75) Inventor: John Knox, Rochester, MI (US)

(73) Assignee: General Sports Venue LLC, Rochester, MI (US)

( * ) Notice: Subject to any disclaimer, the term of this patent is extended or adjusted under 35 U.S.C. 154(b) by 476 days.

(21) Appl. No.: 11/668,696

(22) Filed: Jan. 30, 2007

(65) Prior Publication Data

US 2007/0137017 A1 Jun. 21, 2007

Related U.S. Application Data

(63) Continuation of application No. 10/887,405, filed on Jul. 8, 2004, now Pat. No. 7,189,445.

(51) Int. Cl.
*E01C 13/02* (2006.01)
*E01C 13/08* (2006.01)
*A63C 19/04* (2006.01)

(52) U.S. Cl. ..... 405/43; 405/36; 428/17; 428/95; 428/87; 472/92

(58) Field of Classification Search ..... 428/17, 428/95, 87; 472/92; 156/279; 273/DIG. 13; 405/36, 229, 302.4, 119, 43
See application file for complete search history.

(56) References Cited

U.S. PATENT DOCUMENTS 4,152,473 A * 5/1979 Layman ..... 428/17
4,755,401 A * 7/1988 Friedrich et al. ..... 428/17
4,913,596 A * 4/1990 Lambert, III
5,064,308 A * 11/1991 Almond et al.
5,514,722 A 5/1996 Di Geronimo
5,605,721 A 2/1997 Di Geronimo
5,647,689 A * 7/1997 Gunter
5,647,692 A * 7/1997 Gunter
5,752,784 A * 5/1998 Motz et al.
5,779,393 A * 7/1998 Gunter
5,853,262 A * 12/1998 Vogel
5,958,527 A * 9/1999 Prevost ..... 428/17
5,976,645 A 11/1999 Daluise et al.
6,029,397 A * 2/2000 Motz et al. ..... 47/58.1 R
6,070,824 A 6/2000 Du Pont (Continued)

FOREIGN PATENT DOCUMENTS

DE 19638136 A1 * 3/1998

(Continued)

*Primary Examiner*—Cheryl Juska
(74) *Attorney, Agent, or Firm*—Dickinson Wright PLLC

(57) ABSTRACT

A durable and wear resistant synthetic sports field having at least one strip having a plurality of fibrillated polypropylene strands tufted within a multilayer backing material. The strands are tufted in a wide variety of pile heights, patterns, gauges, and stitch patterns depending upon end use. The multiplayer backing material has a top mesh polypropylene layer at least three layers of a backing material coated with a secondary coating used to contain the ends of the plurality of strands. The strips are placed onto a fine aggregate layer placed over a coarse aggregate layer and a geotextile fabric. The geotextile fabric is placed onto a compacted and leveled subgrade. A ground rubber infill, with or without sand particles and diatomaceous earth, is introduced onto the strips. In alternative arrangements, a series of perforated drains and drain tiles may be introduced to the coarse aggregate layer to promote drainage.

46 Claims, 7 Drawing Sheets

U.S. PATENT DOCUMENTS 6,132,137 A * 10/2000 Gunter
6,247,267 B1 * 6/2001 Motz et al. ..... 47/58.1 R
6,551,689 B1 * 4/2003 Prevost ..... 428/143
6,602,113 B2 * 8/2003 Lemieux ..... 451/38
6,805,936 B2 10/2004 Seaton
6,818,274 B1 11/2004 Buck et al.
6,877,932 B2 * 4/2005 Prevost
6,989,179 B2 * 1/2006 Prevost et al. ..... 428/17
7,128,497 B2 * 10/2006 Daluise
7,147,401 B2 * 12/2006 Wickens
7,155,796 B2 * 1/2007 Cook ..... 29/428
7,175,362 B2 * 2/2007 Carr et al. ..... 404/17
7,189,445 B2 * 3/2007 Knox ..... 428/87
7,264,854 B2 * 9/2007 Stroppiana ..... 428/17
7,290,958 B2 * 11/2007 Blackwood
7,306,838 B2 * 12/2007 Prevost ..... 428/87
7,357,966 B2 * 4/2008 Dipple et al.
7,503,726 B2 * 3/2009 Blackwood ..... 405/50
7,578,635 B2 * 8/2009 Blackwood ..... 405/50
2002/0136846 A1 * 9/2002 Prevost ..... 428/17
2003/0039511 A1 * 2/2003 Prevost ..... 405/36
2003/0039773 A1 * 2/2003 Paschal et al. ..... 428/17
2003/0092531 A1 * 5/2003 Daluise ..... 482/1
2003/0161996 A1 * 8/2003 Prevost ..... 428/143
2003/0175448 A1 * 9/2003 Prevost ..... 428/15
2004/0005194 A1 * 1/2004 Williams et al. ..... 405/43
2004/0037975 A1 * 2/2004 Stroppiana ..... 428/15
2004/0109976 A1 * 6/2004 Holeschovsky et al. ..... 428/95
2004/0219308 A1 * 11/2004 Prevost et al. ..... 428/17
2004/0234719 A1 11/2004 Jones
2005/0008793 A1 * 1/2005 Prevost ..... 428/17
2005/0042032 A1 * 2/2005 Motz et al. ..... 405/43
2005/0129903 A1 * 6/2005 Carr et al. ..... 428/85
2005/0129904 A1 6/2005 Hubbs
2005/0129906 A1 * 6/2005 Knox ..... 428/95
2005/0238433 A1 10/2005 Daluise
2005/0250421 A1 * 11/2005 Monko ..... 451/28
2005/0281963 A1 12/2005 Cook
2006/0029472 A1 2/2006 Blackwood et al.
2006/0039754 A1 2/2006 Linville
2006/0067791 A1 * 3/2006 Wickens ..... 405/43
2006/0078386 A1 * 4/2006 Blackwood ..... 405/43
2006/0093783 A1 * 5/2006 De Clerck ..... 428/92
2006/0121236 A1 * 6/2006 Prevost ..... 428/85
2007/0098925 A1 * 5/2007 Daluise ..... 428/17
2007/0116521 A1 * 5/2007 Kim ..... 405/43
2007/0166508 A1 * 7/2007 Waterford ..... 428/90
2007/0248772 A1 * 10/2007 Cook ..... 428/17
2008/0017563 A1 * 1/2008 Cook et al. ..... 210/164
2008/0216437 A1 * 9/2008 Prevost et al. ..... 52/589.1

FOREIGN PATENT DOCUMENTS

GB 2225240 A 5/1990
JP 53005233 A 1/1978
JP 2003171908 A * 6/2003

* cited by examiner

SYNTHETIC SPORTS TURF HAVING IMPROVED PLAYABILITY AND WEARABILITY

CROSS REFERENCE TO RELATED APPLICATION

This application is a Continuation of U.S. patent application Ser. No. 10/887,405 entitled "Synthetic Sports Turf Having Improved Playability And Wearability" filed on Jul. 8, 2004.

TECHNICAL FIELD AND INDUSTRIAL APPLICABILITY OF THE INVENTION

The present invention relates generally to synthetic sports fields and more specifically to a synthetic sports turf having improved playability and wearability.

BACKGROUND OF THE INVENTION

Synthetic grass sports surfaces are well known. These surfaces are becoming increasingly popular as replacements for natural grass surfaces in stadiums, playgrounds, golf driving ranges, and a variety of other facilities. The synthetic grass surfaces stand up to wear much better than the natural grass surfaces, do not require as much maintenance, and can be used in partially or fully enclosed stadiums where natural grass cannot typically be grown.

Most synthetic grass surfaces comprise rows of strips or ribbons of synthetic grass-like material, extending vertically from a backing mat with particulate material infill in between the ribbons on the mat. One or more layers of aggregate material are introduced between the backing mat and on top of a smoothed and compacted subgrade. The surfaces are preferably crowned to promote water drainage.

The ribbons of synthetic grass-like material usually extend a short distance above the layer of particulate material and represent blades of grass. The length of these fibers is dictated by the end use of the playing surface. For example, football fields utilize fibers that are longer than golf driving range surfaces.

The particulate material usually comprises sand, as shown by way of example in U.S. Pat. Nos. 3,995,079 and 4,389,435, both to Haas, Jr. The particulate matter can also comprise a mixture of sand and other materials, including rubber infill, as shown, for example, in U.S. Pat. No. 6,338,885 to Prevost. In these systems, the rubber infill and sand together provide resiliency to the synthetic grass surfaces. In addition, the sand particles add weight to hold down the backing material, thus helping to ensure that the strips of synthetic grass do not move or shift during play.

While the growth of synthetic grass surfaces has grown exponentially over the past quarter century, the technology used in forming the grass surfaces and laying the synthetic fields is still relatively new. As such, issues surrounding durability and application techniques still exist.

It is thus highly desirable to produce a synthetic grass surface having improved durability that can be used on all types of playing surfaces, including but not limited to football fields, soccer fields, tennis courts, and golf driving ranges.

SUMMARY OF THE INVENTION

The present invention is directed to a new and improved synthetic grass surface that can be used in all types of end use applications. The present invention is also directed at a method for laying a playing field utilizing this new and improved synthetic grass surface.

The durable and wear resistant synthetic sports field having at least one strip having a plurality of fibrillated polypropylene strands tufted within a multilayer backing material. The strands are tufted in a wide variety of pile heights, patterns, gauges, and stitch patterns depending upon end use.

The multilayer backing material has at least one layer of a woven polypropylene material and a bottom polypropylene backing layer coated with a secondary coating used to contain the ends of the plurality of strands. The secondary coating is punched with holes to facilitate drainage. The strips are placed onto a fine aggregate layer placed over a coarse aggregate layer and a geotextile fabric. The geotextile fabric is placed onto a compacted and leveled subgrade. In alternative arrangements, a series of perforated drains and drain tiles may be introduced to the coarse aggregate layer to promote drainage.

A ground rubber infill is introduced onto the strips for use on sports fields such as football fields and soccer fields. A portion of the infill may also comprise diatomaceous earth, which aids in drainage and acts as an insect repellent. Sand particles are introduced to the infill when the sports field is used as a golfing mat.

Other objects and advantages of the present invention will become apparent upon considering the following detailed description and appended claims, and upon reference to the accompanying drawings.

DETAILED DESCRIPTION AND PREFERRED EMBODIMENTS OF THE INVENTION

Figure 1:
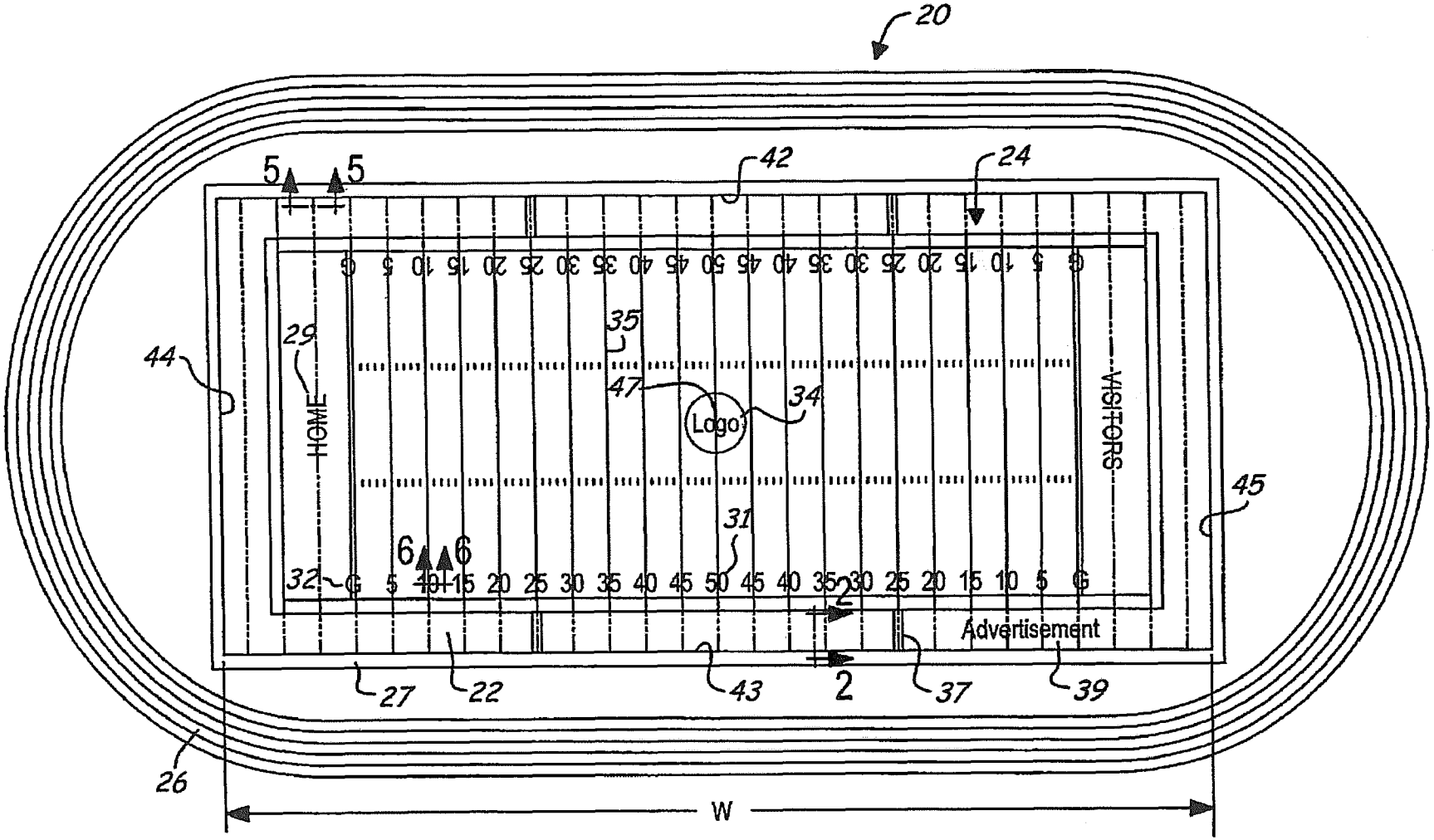
FIG. 1 is a top plan view of a sports field according to one preferred embodiment of the present invention.
Figure 2:
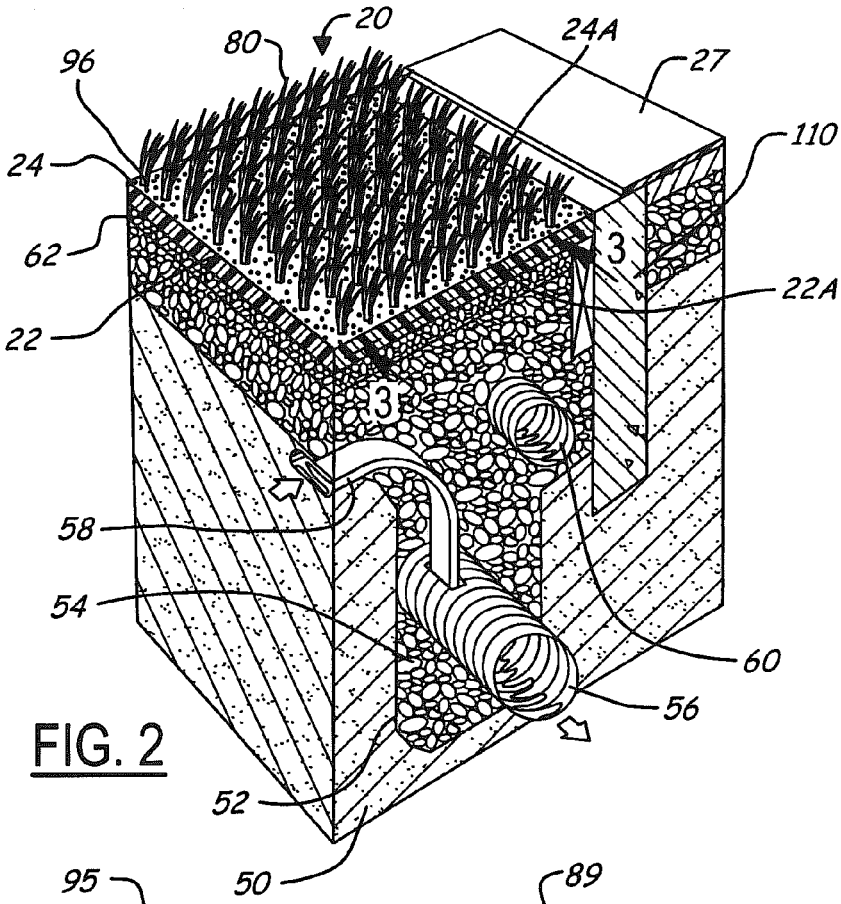
FIG. 2 is a section view of a portion of the sports field of FIG. 1.

FIGS. 1 and 2 illustrate a top and side section views of a sports playing surface 20, here a football field, according to one preferred embodiment of the present invention. The surface 20 has one or more strips 22 of a synthetic turf layer 24 placed lengthwise from one widthwise end 42 to the other widthwise end 43 (shown as being laid top to bottom in FIG. 1). The number of strips 22 is determined by the overall width w of the field 20 extending a first lengthwise side 44 to a second lengthwise side 45 (shown as the left side and right side on FIG. 1). As one of ordinary skill envisions, the direction that the strips are laid is inconsequential as far as the performance of the field and is thus not meant to be limited to the directions described herein. In addition, a track 26 may be installed around the playing surface 20. The playing surface 20 and the track 26 are usually separated by a concrete curb 27. The playing surface 20 is coupled to a polywood fastener 110 that is affixed to the concrete curb or curb shoulder 27 and prevents shifting of the playing surface 20 during use. The track 26 surface is a rubberized or cinder surface as is well known to those of ordinary skill in the art in track and field.

The playing surface 20 has may have a series of numbers 31, letters 32, logos 34, yard lines 35, sideline markings 37, or other markings 39 (collectively features 29), preferably inlaid or stenciled, within or on the surface of one or more strips 22 of the synthetic turf layer 24. The process for inlaying these features 29 is described further below in FIG. 6, while the stenciling process is described further in FIG. 7.

As best shown in FIG. 2, the playing surface 20 is formed having a geotextile fabric 52 laid onto a compacted and substantially leveled subgrade 50, or subsoil. A preferred geotextile fabric 52 is a nonwoven fibrous material such as Pro-Prex® 4546, available from Amoco Fabrics and Fibers Co.

A coarse aggregate draining layer 54 having a pair of perforated drains 56 located on either widthwise end 42, 43 of the field is placed onto the fabric 52. Preferably, the coarse aggregate draining layer 54 is a type 21*aa*, ¾ inch washed stone having 6 alpha gradation. However, other materials that may be used include certain kinds of clay or topsoil meeting a 95 percent proctor rate requirement. For the purposes of the present invention, a 95 percent proctor is the equivalent of a 95 percent maximum dry density.

A plurality of drain tiles 58 are laid across the width of the field 20 from one widthwise end 42 to the other widthwise end 43 of the field and fluidically coupled with each of the respective perforated drains 56. A second perforated drain 60 is also independently placed at each widthwise end 42, 43 of the field 20 to aid in draining the field. These drains 56, 60 may be coupled with a sewer system (not shown) or other drain at a location outside of the track 26. The drain tiles 58 and drains 56, 60 are preferably contained within the coarse aggregate draining layer 54.

Of course, in alternative embodiments such as indoor sports fields and driving range mats, it may not be necessary or cost effective to introduce drains 56, 60 and drain tiles 58 with the field 20 to facilitate drainage of water.

A layer of fine aggregate draining layer 62 is then introduced over the coarse aggregate draining layer 54. Preferably, the fine aggregate layer 62 is a ⅜ inch washed stone aggregate material. Obviously, the fine aggregate layer may take on a variety of different materials.

Figure 5:
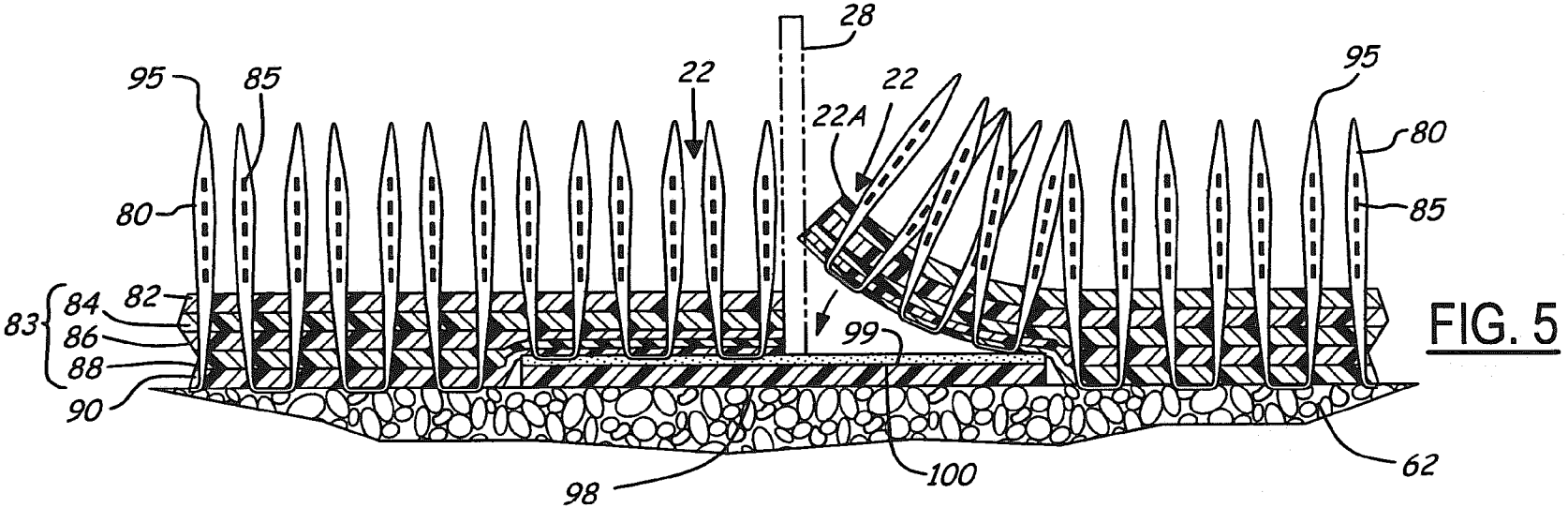
FIG. 5 is a section view of a portion of the sports field of FIG. 1.

Strips 22 of the synthetic grass material 24 are placed on top of the fine aggregate draining layer 62 in rows across the field such that the respective edges 22A of adjacent strips 22 are substantially lined up. As best shown in FIG. 5 and described further below, the adjacent strips 22 are coupled together using a Cordura seam layer 98 and an adhesive 100. However, a variety of other methods may be utilized to couple adjacent strips 22 together. A layer of infill 96 is disposed interstitially among the strands 80 on top of the backing layer 81. For areas outside of the actual defined playing surface (such as along the sidelines of a football field), the strips 22 may be placed perpendicular to the ends of the strips contained on the actual defined playing surface.

As best shown in FIGS. 3 and 4A-D, the synthetic grass surface 24 has a plurality of fibrillated yarn strands 80 tufted (stitched) through a backing layer 81 in rows separated by a first distance or gauge. The backing layer 81 preferably is a four part backing layer formed of an optional mesh layer 82 and a series 83 of backing layers 84, 86, 88. A secondary coating 90 is applied to the layer 88 to seal the strands 24 to the backing layer 81 and to add a layer of dimensional stability to the backing 81. The secondary coating 90 is applied at about 24 to 30 ounces per square foot onto the layer 88.

A series of holes 94 are then punched through the series 83, mesh layer 82 and secondary coating 90 at predetermined locations, preferably directly above drain tiles 58, to promote drainage.

The mesh layer 82 preferably is a polypropylene woven mesh layer having a construction warp of 94 threads per 10 cm and a construction weft of 63 threads per 10 cm that allows water to easily penetrate through the material while giving a tough, wear resistant surface. Obviously, it may take on other configurations.

In one preferred embodiment, the backing layer 84 is preferably a woven polypropylene/polyethylene layer having a construction polypropylene warp fiber of 94 threads per 10 cm and a construction polyethylene weft fiber of 63 threads per 10 cm. Backing layer 86 is preferably a spun bound, non-woven polypropylene backing which provides exceptional dimensional stability, thus preventing wrinkling. This non-woven backing 86 is preferably bonded to the backing layer 84, known in the art as "FLW", and includes a layer of fiber fleece 88. The fleece layer 88 and non-woven backing layer 86 are open in nature and help to absorb the secondary coating 90, which helps bond the fibrillated yarn strands 80 and add strength and stiffness to the grass surface 24. One preferred backing material contains layers 84, 86, 88 is Thiobac™, available from TC Thiolon USA™ of Dayton, Tenn. Alternative versions of Thiobac™ may also be formed to include the mesh layer 82.

In another alternative preferred embodiment, the series 83 of backing layers 84, 86, 88 are formed of an all-woven backing material. Layers 84 and 88 are preferably a woven polypropylene/polyethylene layer having a construction polypropylene warp fiber of 94 threads per 10 cm and a construction polyethylene weft fiber of 63 threads per 10 cm. Layer 86 is preferably a woven polypropylene secondary backing material such as Amoco Chemical's Action Bac® woven material, which is a backing made of a leno weave of slit film and spun olefin yarns that form a stretchable, all synthetic backing fabric.

The strands 80 are preferably fibrillated polyethylene fibers broken up into a plurality of blades 89 and having a blade thickness of about 80-110 microns, a fiber width of about 12 millimeters, and a pile length that varies from 0.5 to 2.5 inches depending upon end use. For football fields, longer pile lengths around 2.5 inches are preferred. For soccer fields, wherein the soccer ball moves generally along the grass surface, shorter pile lengths of about 1.5 inches are generally preferred. For golf driving mats, pile lengths of approximately 0.5 inches are used to simulate fairway conditions. Similarly, for non-sports related applications, such as for walking areas, pile lengths are generally on the lower end of the preferable range.

Figure 3:
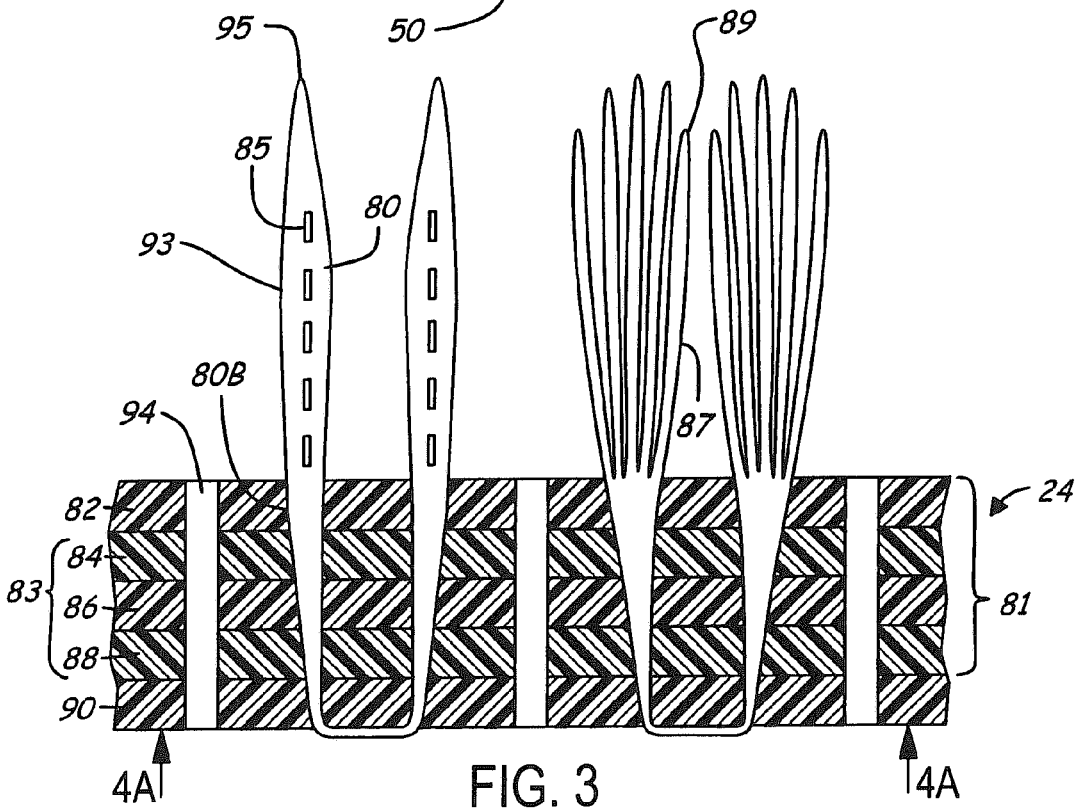
FIG. 3 is a section view of another portion of the sports field of FIG. 1.

FIG. 3 illustrates a plurality of strands 80 both prior to and after fibrillation into a plurality of blades 89. The leftmost strand 93 of the plurality of strands 80 in FIG. 3 is shown prior to fibrillation and containing a number of fibrils 85. In the rightmost strand 87 of the plurality of strands 80, the fibrils 85 are broken up, therein producing a plurality of blades 89 from an individual fibrillated strand 80.

Two preferred strands 80 particularly suited for football fields are Thiolon XP™ and Thiolon LSR™ fibrillated polyethylene strands, each available from TC Thiolon USA™ of Dayton, Tenn. The Thiolon XP™ does not have as many fibrils as the Thiolon LSR™ strand, therein producing a thicker, heartier blade when fully fibrillated.

In conjunction with pile length, blade thickness, and fiber width, the strands 80 have a certain mass per unit length, or denier, that contributes to the overall plushness and playability of the field. Larger deniers equate to strands 80 having a larger mass per unit length. Thus, where high plushness is desired, such as with sports surface, including football and soccer fields, the strands 80 have a denier of at least 10000, while other non-sports related fields 20 may have deniers of less than 10000.

The strands 80, when applied to the backings 82, 84, 86, 88, will be configured to lay a particular way on the backing. In other words, the tufting process is performed such that the uppermost ends 85 of the strands 80 will naturally fall substantially in the same direction. The grain of the strip 22 can therefore be classified as "with the grain" or "against the grain," depending upon an observer's relative position. A "with the grain" positioning is thus defined wherein the uppermost end 95 of the strand 80 has fallen in a direction away from a viewer's eye relative to the tufted portion 80B of the strand, while an "against the grain" positioning is defined wherein the uppermost end 95 of the strand 80 falls towards a viewer's eye. The importance of this grain classification will become evident below.

In addition, the strands 80 are stitched into the backing layers 82, 84, 86, 88 at a stitch rate of between about 7 and 24 stitches per 3-inch period. The strands 80 have a gauge of between ⅛ and ½ inch, depending upon the end use application of the field. The smaller the gauge, the plusher the field. In addition, a smaller gauge adds additional barriers to prevent the movement of the infill 96 during use and weather conditions such as rainfall and wind, as additional rows of strands 80 physically prevent infill 96 movement.

Figure 4A:
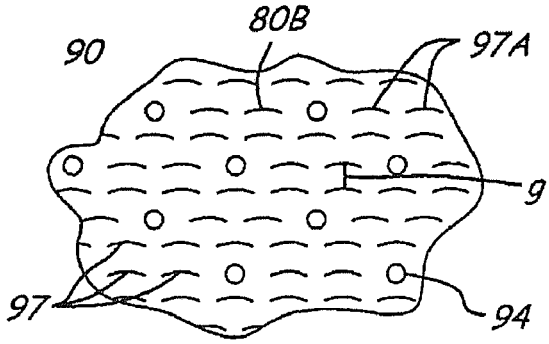
FIGS. 4A-4D are bottom views of the section of the sports field of FIG. 3.
Figure 4B:
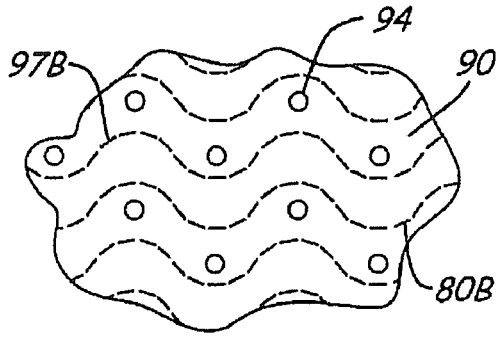
Figure 4C:
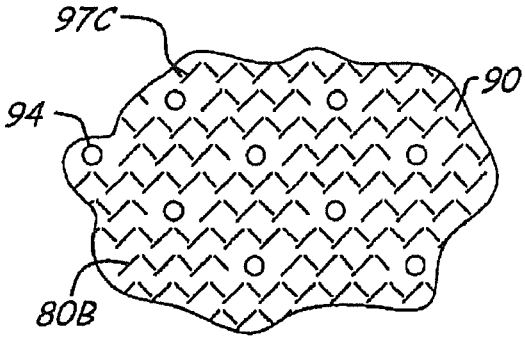
Figure 4D:
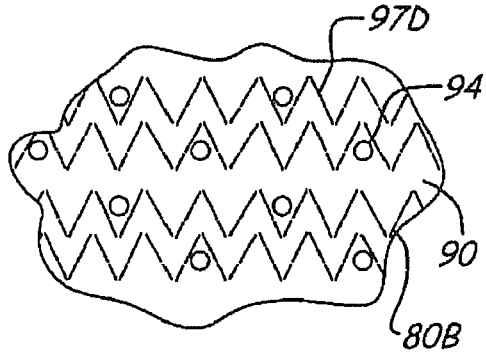

As best shown in FIGS. 4A-4D, the stitch pattern 97 of strands 80 within the backing layers 82, 84, 86, 88 may vary depending upon the desired look and plushness. In FIG. 4A, for example, the strands 80 are stitched in a substantially linear pattern 97A. In FIG. 4B, the strands 80 are stitched in a "lazy s" pattern 97B. In FIG. 4C and 4D, the strands 80 are stitched in a single herringbone 97C or double herringbone pattern 97D. In particular, the single herringbone pattern 97C of FIG. 4C and the double herringbone pattern 97D of FIG. 4D are preferable for use on fields 20 having a crown sloping downward from the center to the sides 42, 43, 44, 45, in that these patterns help to prevent the overlaid infill 96 from washing away from the center towards the sides during heavy rainstorms.

The gauge (shown as g on FIG. 4A), as people of ordinary skill in the carpeting understand, refers to the average distance between rows of fiber strands 80. The smaller the gauge, the more fibers per unit distance, and hence the plusher the field. In addition, the smaller gauge helps to prevent the overlaid infill 96 from washing out during heavy rainstorms.

As best shown in FIG. 5, the strips 22 of the field 20 are coupled together by first rolling back the sides 22A of each respective strip 22 so that a Cordura (12 inch nylon cordor matting available from Top Value Fabrics of Carmel, Ind.) seam layer 98 can be placed onto the fine aggregate layer 62 within an opening 63 created between the rolled up strips 22. An adhesive 100, or glue, is then applied to the top 99 of the Cordura seam layer 98. The strips 22 are then rolled back onto the seam layer 98 such that the ends 22A of each adjacent strip 22 are substantially aligned. The adhesive 100 then adheres to the secondary coating 90 of the grass surface 24 to maintain the strips 22 is a position of close proximity to one another.

One preferred adhesive 100 is Nordot 346, which is available from Synthetic Surfaces of Scotch Plains, N.J.

Figure 7:
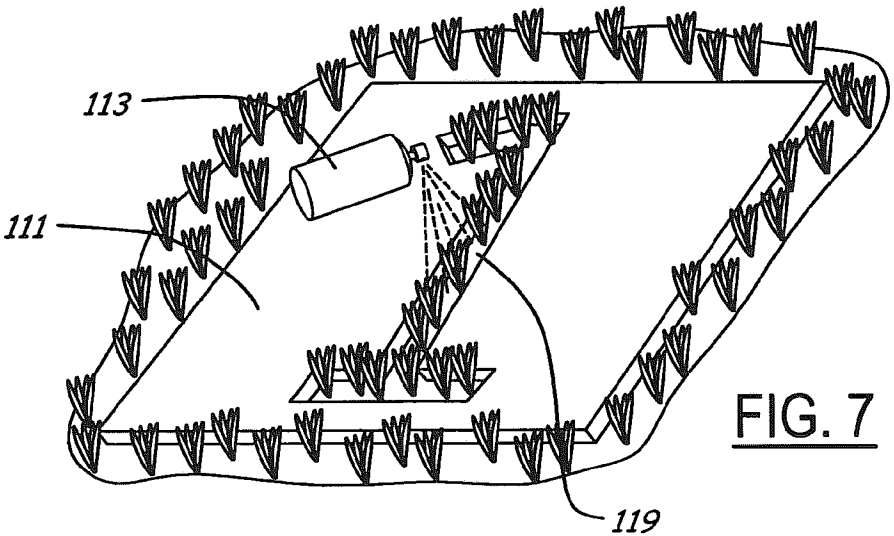
FIG. 7 is a section view of a portion of the sports field of FIG. 1.
Figure 6:
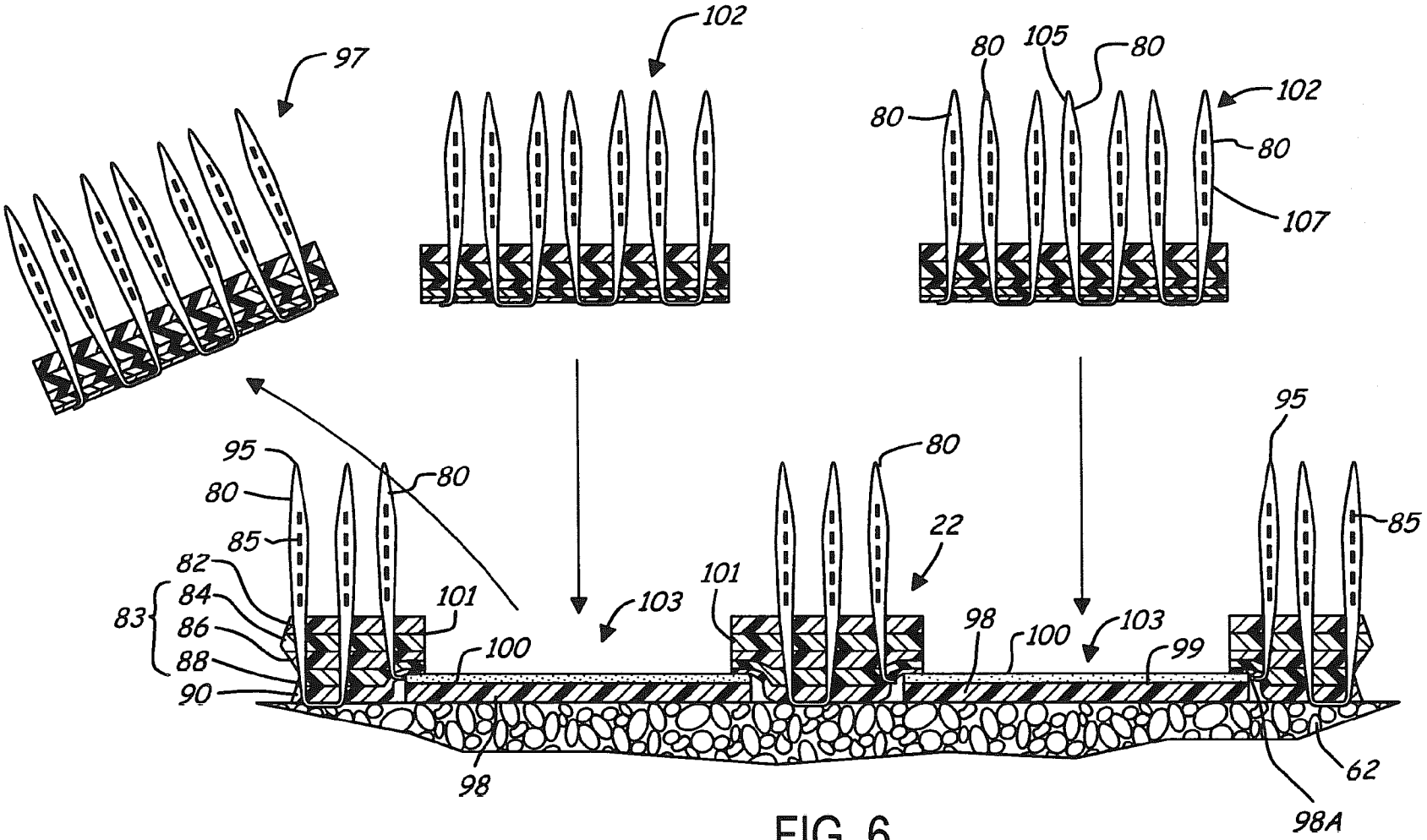
FIG. 6 is a section view of a portion of the sports field of FIG. 1.

Next, as shown in FIGS. 6 and 7, numbers, letters, logos, and other markings may be introduced to the field using an inlaying or stenciling process.

In the inlaying process, as best shown in FIG. 6, a template (shown as 111 on FIG. 7) is introduced onto the strips 22 of the field 20 at a position determined by laser plotting or some other kind of alignment technique. A cutting utensil is used to cut through the backing layers 82, 84, 86, 88, corresponding to the edges of the stencil 111, within an opening (shown as 119 on FIG. 7). The cut out portion 97 of the strip 22 or strips 22 is removed leaving an opening 103. The edges 101 of the strip or strips 22 are rolled back, and a Cordura seam 98 is introduced to the fine aggregate layer 62. An adhesive 100 is then applied to the top surface 99 of the Cordura strip, and the edges 101 are rolled back down to partially cover some of the seam 98. A new section 102 of the synthetic grass material 24, colored as desired, corresponding in size to the cut out portion 97, is then laid onto the adhesive 100 within the opening 103.

Alternatively, the new section 102 may consist of an inner portion 105 and a border portion 107, each having different colored strands 80, wherein the border portion 107 "brings out" or highlights the inner portion 105. The inner portion 105 and the outer portion 107 may be formed as one multicolored piece, or as two separate pieces.

To install the inner portion 105 and the outer portion 107 as two separate pieces, a cutting utensil is used to cut through the backing layers 82, 84, 86, 88 corresponding to the edges of the stencil. The cut out portion 97 of the strip or strips 22 is removed leaving an opening 103. The edges 101 of the strip or strips 22 are rolled back, and a Cordura seam 98 is introduced to the fine aggregate layer 62. An adhesive 100 is then applied to the top surface 99 of the Cordura seam 98, and the edges 101 are rolled back down to partially cover a portion 98A of the seam 98. Preferably, the portion 98A extends at least 12 inches within the edge 101 of the strip 22 to ensure solid adhesion between the strip 22 and the Cordura seam 98.

The border or outer portion 107 is then placed onto the adhesive layer 100 within the opening 103 such that the border or outer portion 107 substantially abuts the edges 101 of the strips 22. The inner portion 105 is then placed within the border or outer portion 107.

Of course, as one of ordinary skill recognizes, multicolored numbers 30, letters 32, and logos 34 may be introduced using the inlayed process as one, two or multiple new sections 102 introduced within the opening 103 as described above.

In the stenciling process, as shown best in FIG. 7, a template 111 is introduced onto the strips 22 of the field 20 at a position determined by laser plotting or some other kind of alignment technique. A can of spray paint 113 is then sprayed within the opening 115 of the template 111 onto the surface of the strip 22. The template 111 is removed and the paint is allowed to dry, therein forming one color of the numbers 30, letters 32, and/or logos 34. The process may be repeated to introduce a border (similar to 103 in FIG. 6) or to introduce other colors within the painted regions.

The infill 96 is introduced on top of the mesh 82 at a thickness commensurate with the pile length of the strands 80 that allows the uppermost end 85 to extend above the thickness of the infill 96. For the football field shown in the preferred embodiments of FIGS. 1 and 2, the thickness is between approximately 1.5 and 2.5 inches and has a density of between about 3 and 3.5 pounds per square foot.

For a football field, the infill 96 is composed of cryogenically ground vulcanized scrap rubber having a sieve of between approximately 8 and 30, and more preferably between 10 and 15. This rubber is preferably 100 percent recycled post-consumer automobile tires, and therein provides an environmentally friendly use for these products. However, other cryogenically ground vulcanized rubber products that meet the desired specifications may be utilized as the infill 96, alone or in combination with automobile tire rubber. For example, ground rubber recycled rubber may come from certain types of shoes.

In addition, for outdoor fields, it is preferable that a portion of infill 96, preferably up to about 5% by weight, and more preferably between about 2.5 and 5% by weight, be composed of diatomaceous earth (DE). DE is a naturally occurring mineral formed from skeletal remains of diatoms. It is non-toxic, non-flammable and environmentally friendly. DE particles are capable of absorbing 4 times its weight in water. Thus, the DE ensures that playing surfaces dry faster after rainstorms. Further, the absorption and desorption of water causes the particles of DE to expand and contract. This helps to ensure that the infill 96 remains porous and uncompacted. In addition, DE is a natural insecticide, which provides insect repellant characteristics.

For indoor fields, a portion or all of the cryogenically ground rubber may be replaced by ambiently ground rubber. As those of ordinary skill in the art recognize, however, ambiently ground rubber produces irregular jagged shaped particles that may not be beneficial for sports surfaces. In addition, the process for forming the rubber particles may degrade the rubber due to excess heat buildup. Also, and most relevant in the case of outdoor sports fields, excess heat generated by environmental conditions (the sun and outdoor air temperature) may act to degrade the rubber infill. As such, ambiently ground rubber is not desirable for outdoor sports playing surfaces.

For golfing surfaces, and specifically golf driving range surfaces, the infill 96 is a mixture of 40 percent by weight (per square foot) ground rubber and 60 percent silica sand. The infill 96 may also optionally contain up to about 5% by weight of diatomaceous earth. The mixture more closely simulates the surface of a golfing fairway or tee. The rubber portion of the infill 96 can be cryogenically ground rubber, ambiently ground rubber or a combination of cryogenically and ambiently ground rubber having a mesh size between about 16 and 25, and more preferably about 16 mesh. The silica sand has a sieve size of about 25 mesh. Preferably, about 5 pounds of infill 96 are introduced to golfing surfaces having a pile height of about ½ inch so that the infill covers roughly ⅔ of the pile height.

Figure 8:
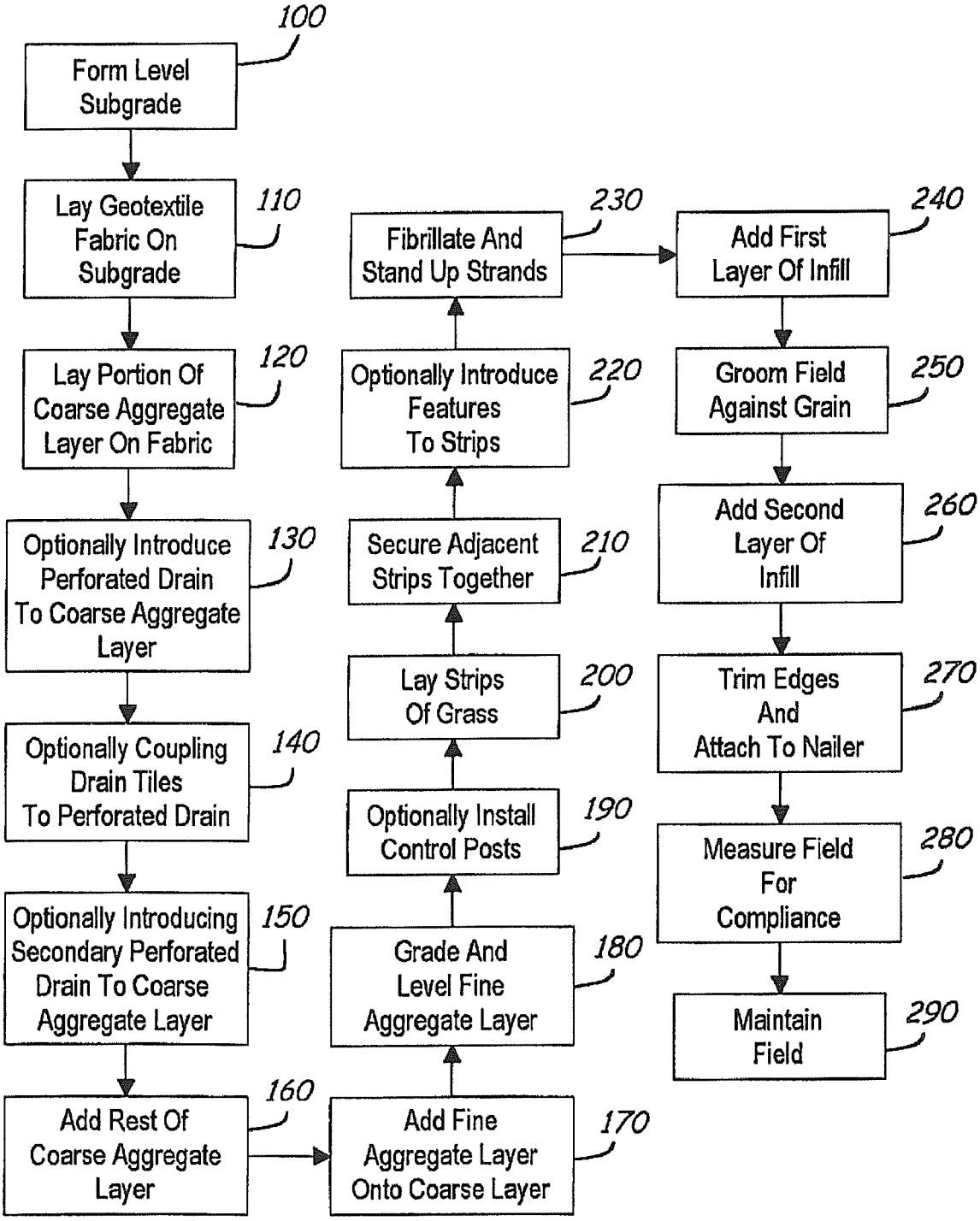
FIG. 8 is a logic flow diagram for forming a sports field according to one preferred embodiment of the present invention.
Figure 9:
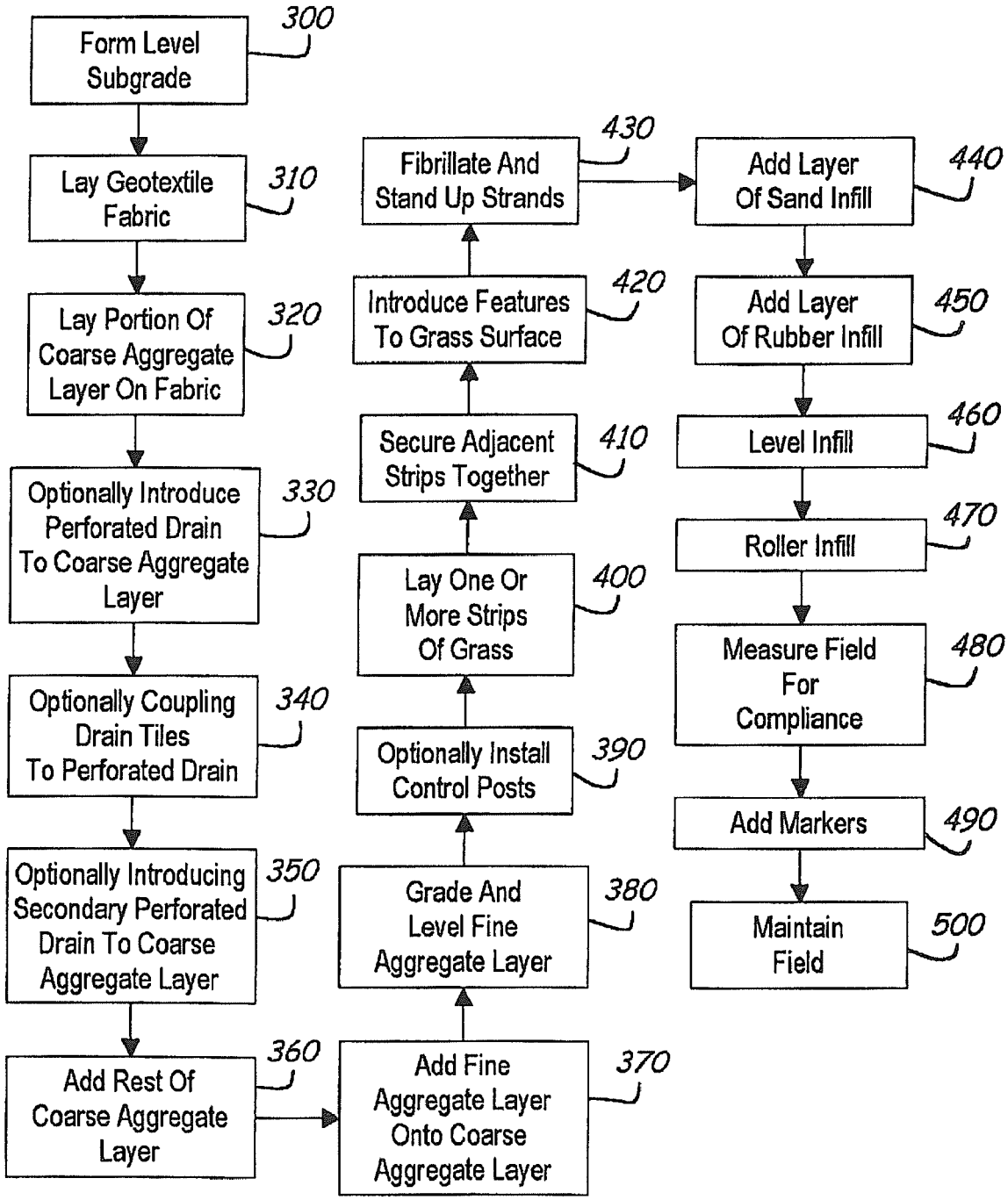
FIG. 9 is a logic flow diagram for forming a golf surface similar to the sports field shown in FIG. 2.

FIGS. 8 and 9 illustrate a logic flow diagram for making a sports field as shown in FIGS. 1 and 2 in accordance with a preferred embodiment of the present invention. FIG. 8 illustrates a football field, while FIG. 9 illustrates a golfing surface. The logic flow diagrams of FIGS. 8 and 9 assume that a geotechnical and topographical survey has been performed to determine a proper site and design for the sports field. The logic flow diagram also assumes that monuments or other markers are present at the site to aid in designing the sports field.

Referring now to FIG. 8, and in step 100, a level subgrade 50 is first formed. To form a level subgrade 50, usually between 8 and 24 inches of topsoil is first excavated using standard excavation equipment. The excavated topsoil is removed and sent for disposal. Spoils are removed from the surface 51 of the subgrade 50, and the subgrade 50 is then rolled to substantial smoothness. To accommodate water removal in the upper levels, a slight crown may be established from the center 47 of the field to the ends 42, 43 and sides 44, 45 within the subgrade 50.

Next, in Step 110, a geotextile fabric 52 is laid onto the smoothed subgrade 50. In Step 120, a portion of a coarse, aggregate draining layer 54 is added onto the geotextile fabric 52.

Next, in Step 130, a perforated drain 56 may optionally be introduced onto the portion of the previously laid coarse draining layer 54 along the length of each widthwise end 42, 43 of the field extending from side 44 to side 45. The perforated drains 56 are sloped at about 0.5 percent downward from one side 44 to the other side 45, or vice versa, as it extends in a direction perpendicular to the overlying strips 22 of synthetic grass.

In Step 140, a series of drain tiles 58 are optionally coupled to the perforated drains 56 and extended within the aggregate layer 54, preferably along the length of the strips 22 and perpendicular to the length of the perforated drains 56. In the embodiment shown in FIGS. 1 and 2, the drain tiles 58 are installed approximately every 20-30 feet, and more preferably every 24 feet, beneath the length of the strip 22 extending from widthwise end 42 to widthwise end 43 of the field 20. The drain tiles 58 are preferably laid in a herringbone pattern to cover more surface area beneath the overlying strips 22. In this way, water draining from the overlying strips 22 can be removed quickly, therein substantially reducing the appearance of puddles on the surface of the strips 22 as a result of inclement weather.

Of course, as one of ordinary skill appreciates, the location of the drains 56 and drain tiles 58 may be placed in any other configuration that allows adequate draining of the surface of the field 20 at a rate desired. For example, the drains 56 may alternatively run along the sides 44, 45 of the field, with the coupled drain tiles 58 running perpendicular to the strips 22 and still fall within the spirit of the present invention.

In addition, as shown in Step 150, a secondary perforated drain 60 is optionally and preferably laid parallel to drain 56 along the ends 42, 43 and closer to a visible surface of the playing surface 20 that is not coupled to the respective drain tiles 58. The secondary perforated drain 60 catches water that drains along the surface of the strips 22 as it drains due to the overall crowning of the overlying strips 22. The drains 56, 60 are preferably fluidically coupled to a sewer drain (not shown) to facilitate water removal. However, the drains 56, 60 may simply end into a drainage ditch or other water detention area.

The rest of the coarse aggregate draining layer 54 is introduced over the drains 56, 60 and the drain tile 58 to secure the positioning of the drains 56 and the tile 58 in Step 160. The thickness of the aggregate draining layer 54 is preferably about 6 to 8 inches in the center 47 of the field 20, but may be thicker along the ends 42, 43 and sides 44, 45 to accommodate the drains 56, 60 and facilitate water removal.

Next, in Step 165, the proctor and density of the coarse aggregate layer are checked to ensure that they comply with the site specifications.

Next, in Step 170, a fine aggregate layer 62 is introduced onto the coarse aggregate layer 54 at a thickness of about 1 to 3 inches, and more preferably to about 2 inches. The fine aggregate layer 62 is applied such that the field 20 slopes ½ percent from the center 47 of the fields to the ends 42, 43 in one embodiment. This is the equivalent of about a 6 to 12 inch height difference from the center 47 to each respective widthwise end 42, 43 on a standard football field.

At this point, in Step 180, the fine aggregate layer 62 is graded and leveled. To ensure the leveling is consistent, a laser (not shown) is preferably be used to measure the levelness throughout the layer 62.

In Step 185, the layer 62 is then rolled using machine rollers to ensure a 95 percent proctor. In addition, the fine aggregate layer 62 is compaction tested to ensure compliance with the field specifications.

In Step 190, a series of control posts (shown as 28 on FIG. 5) are temporarily installed into the aggregate layers 62, 54 at predetermined positions using laser sights. The location of the control posts is determined from monuments or other location markers typically installed prior to commencement of installation of the sports field. For example, in the case of a football field, the posts 28 are positioned in areas representing yard lines, hash marks, end zones, and sidelines.

Next, in Step 200, the strips 22 of grass surface 24 are laid onto the fine aggregate layer 62 using rollers, preferably aligning the field strips 22 using control posts 28. The strips 22 are laid such that the secondary coating 90 is closely coupled to the fine aggregate layer 62 while the upper ends 95 of the strands 80 are located at the further point away from the fine aggregate layer 62.

In the case of a football field, the strips 22 are laid wherein the grain lies in the same direction across the length I of the field (i.e. wherein the appearance of the field as observed by a person on a first side is either "with the grain" or "against the grain"). For example, the strips 22 are all laid in a "against the grain" pattern with respect to a first lengthwise side 44 of the field 20, wherein an observer standing along a first lengthwise side would be able to see tops of the uppermost ends 95 of the strands. As one of ordinary skill recognizes, people viewing the field 20 from the first lengthwise side 44 would thus view the field as having a darker, plusher appearance, while people viewing the field from the second lengthwise side 45 would observe a shinier, less plush appearance, wherein the topmost end 95 lays in a direction away from the observer.

Alternatively, the strips 22 may be laid in an alternating "against the grain"/"with the grain" approach so as to simulate a freshly mowed grass surface.

Further, the strips 22 of grass constituting the sideline are preferably laid in an orientation perpendicular to the strips 22 constituting the playing portion of the football playing field.

In Step 210, the strips 22 are secured together at the sides 22A using a Cordura seam layer 98 and an adhesive 100 as described above in FIG. 5.

Next, in Step 220, if desired, the numbers 32, letters 34, and or logos 36 (i.e. the "features") are introduced to portions of the strips 22 by either the inlaying or stenciling process described above in FIGS. 6 and 7.

Next, in Step 230, a mechanical rotary brush (not shown) is introduced to the strands 80 to fibrillate and stand up the strands on top of the backing layers 82, 84, 86, 88. This is done by moving the mechanical brush in a direction "against the grain" on the strands 80. This breaks the fibrils 85 contained on the strands 80, therein converting on strand 80 into many separate blades 89, therein giving the grass surface 24 a plusher, more natural grass-like look. A lawn sweeper (not shown), preferably a Parker Lawn Sweeper, is then introduced to remove loose fibers, glue, contaminants, or other debris from the field 20 (i.e. clean the surface).

At this point, the process for forming the football surface, shown in FIG. 8, diverges from the process for forming the golf surface, shown in FIG. 9.

In Step 240 of FIG. 8, a first layer of cryogenically ground rubber infill 96 is introduced onto the football field using a top dressing unit (not shown). The composition of the infill 96 is dependent upon the ultimate use for the field 20.

After introducing the first amount of infill 96, in Step 250, the football field is brushed "against the grain" with a mechanical rotary brush and then brushed with a grooming brush. One preferred grooming brush is the Sweepmaster Turf Brush, sold by Gandy Products of Owatonna, Minn.

Next, in Step 260, one or more additional layers of infill 96 are added such that the tops of the blades 24A are exposed through the infill 96. The grooming brush grooms and levels the infill 96 such that the infill 96 has a density of between about 3 and 3.5 pounds per square foot and a thickness between approximately 1.75 and 2.5 inches in thickness over the topmost layer 84 of the backing material 83.

In Step 270, the strips 22 are trimmed along the edges 42, 43 and sides 44, 45 and attached to a polywood fastener 110 that extends around the field 20 and within the track 26. The polywood fastener 110 abuts and is coupled to the concrete curb 27. Alternatively, the strips 22 could be attached to the polywood fastener prior to introduction of the infill 96. This prevents the field strips 22 from shifting during play. The preferred method of attachment is via wood screws and metal washers. The field 20 is then ready for use.

Next, in Step 280, the field 20 is preferably measured using various ASTM standards to ensure compliance with safety requirements. This is done at a wide variety of predetermined locations to ensure uniformity. For example, a football field 20 must have a certain amount of bounce, as measured by ASTM standard F355, in which missile is dropped onto the field to determine the amount of bounce. Currently, football fields must have a bounce not to exceed 175.

As one of ordinary skill recognizes, due to the use of a loose infill 96, it is highly desirous to perform routine maintenance upon the field 20, as shown in Step 290. This includes removing loose debris with a sweeper and measuring infill 96 thickness at various predetermined locations to ensure proper thickness. Other routine maintenance may include agitating the infill 96 to maintain the field at the desired infill consistency, measuring and replenishing infill 96 levels, leveling and compacting the infill 96 using a roller, and watering the field to aid in compaction.

For a golf surface, as shown in FIG. 9, and in step 300, a level subgrade 50 is first formed. To form a level subgrade 50, usually between 8 and 24 inches of topsoil is first excavated using standard excavation equipment. Spoils are removed from the surface 51 of the subgrade 50, and the subgrade 50 is then rolled to substantial smoothness. To accommodate water removal in the upper levels, a slight crown may be established from the center 47 of the field to the ends 42, 43 and sides 44, 45 within the subgrade 50.

Next, in Step 310, a geotextile fabric 52 is laid onto the smoothed subgrade 50. In Step 320, a portion of a coarse, aggregate draining layer 54 is added onto the geotextile fabric 52.

Next, in Step 330, a perforated drain 56 may optionally be introduced onto the previously laid coarse draining layer 52 along the length of each widthwise end 42, 43 of the field extending from side 44 to side 45. The perforated drains 56 are sloped at about 0.5 percent downward from one side 44 to the other side 45, or vice versa, as it extends in a direction perpendicular to the overlying strips 22 of synthetic grass.

In Step 340, a series of drain tiles 58 are optionally coupled to the perforated drains 56 and extended within the aggregate layer 24, preferably along the length of the strips 22 and perpendicular to the length of the perforated drains 56. In the embodiment shown in FIGS. 1 and 2, the drain tiles 58 are installed approximately every 20-30 feet, and more preferably every 24 feet, beneath the length of the strip 22 extending from widthwise end 42 to widthwise end 43 of the field 20. The drain tiles 58 are preferably laid in a herringbone pattern to cover more surface area beneath the overlying strips 22. In this way, water draining from the overlying strips 22 can be removed quickly, therein substantially reducing the appearance of puddles on the surface of the strips 22 as a result of inclement weather.

Of course, as one of ordinary skill appreciates, the location of the drains 56 and the drain tiles 58 may be placed in any other configuration that allows adequate draining of the surface of the field 20 at a rate desired. For example, the drains 56 may alternatively run along the sides 44, 45 of the field, with the coupled drain tiles 58 running perpendicular to the strips 22 and still fall within the spirit of the present invention.

In addition, as shown in Step 350, a secondary perforated drain 60 is optionally and preferably laid parallel to drain 56 along the ends 42, 43 and closer to a visible surface of the playing surface 20 that is not coupled to the respective drain tiles 58. The secondary perforated drain 60 catches water that drains along the surface of the strips 22 as it drains due to the overall crowning of the overlying strips 22. The drains 56, 60 are preferably fluidically coupled to a sewer drain (not shown) to facilitate water removal. However, the drains 56, 60 may simply end into a drainage ditch or other water detention area.

The rest of the coarse aggregate draining layer 54 is introduced over the drains 56, 60 and the drain tile 58 to secure the positioning of the drains 56 and tile 58 in Step 360. The thickness of the aggregate draining layer 54 is preferably about 6 to 8 inches in the center 47 of the field 20, but may be thicker along the ends 42, 43 and sides 44, 45 to accommodate the drains 56, 60 and facilitate water removal.

Next, in Step 370, a fine aggregate layer 62 is introduced onto the coarse aggregate layer 54 at a thickness of about 1 to 3 inches, and more preferably to about 2 inches. The fine aggregate layer 62 is applied such that the field 20 slopes ½ percent from the center 47 of the fields to the ends 42, 43. This is the equivalent of about a 6 to 12 inch height difference from the center 47 to each respective widthwise end 42, 43 on a standard football field.

At this point, in Step 380, the fine aggregate layer 62 is graded and leveled. To ensure the leveling is consistent, a laser (not shown) is preferably be used to measure the levelness throughout the layer 62. The layer 62 is then rolled using machine rollers to ensure a 95 percent proctor.

In Step 390, a series of control posts (shown as 28 on FIG. 5) are temporarily installed into the layers 62, 54 at predetermined positions using laser sights.

Next, in Step 400, one or more of the strips 22 of grass surface 24 are laid onto the fine aggregate layer 62 using rollers, preferably aligning the field strips 22 using control posts 28. The strips 22 are laid such that the secondary coating is closely coupled to the fine aggregate layer while the ends of the strands are located at the further point away from the fine aggregate layer.

In Step 410, wherein more than one strip 22 is utilized, the strips 22 are secured together at the sides 22A using a Cordura seam layer 98 and an adhesive 100 as described above in FIG. 5.

Next, in Step 420, features may be introduced to the golf surface by either the inlaying or stenciling process described above in FIGS. 6 and 7. For example, numerals may be inlayed into the turf in the tee area indicating the distance to objects (i.e., pins or flags).

Next, in Step 430, a mechanical rotary brush (not shown) is introduced to the strands 80 to fibrillate and stand up the strands on top of the backing layers 82, 84, 86, 88. This is done by moving the mechanical brush in a direction "against the grain" on the strands 80. This breaks the fibrils contained on the strands 80, therein converting on strand 80 into many separate blades 89, therein giving the grass surface 24 a plusher, more natural grass-like look. A lawn sweeper (not shown), preferably a Parker Lawn Sweeper, is then introduced to remove loose fibers, glue, contaminants, or other debris from the field 20 (i.e. clean the surface).

In Step 440, a first layer of sand is added to the surface of the golf matting (field) using a drop spreader. The first layer preferably is laid to about 3 pounds per square foot of matting.

Next, in Step 450, a layer of rubber is added to the sand using a hand top dresser. The amount of rubber introduced to the sand layer is about 2 pounds per square foot of matting, such that the cumulative total of sand and rubber in the infill is approximately 5 pounds per square foot.

In Step 460, the infill 96 is leveled using a rotary brush power broom. One preferred power broom is the Shindaiwa PowerBroom PB 270.

In Step 470, a roller is rolled on top of the infill 96 layer to ensure smoothness.

Next, in Step 480, the field 20 is preferably measured using various ASTM standards to ensure compliance with safety requirements.

Next, in Step 490, markers (not shown) may be added onto the surface of the golf matting to provide separate areas wherein golfers may practice hitting golf balls.

As with football fields, the one or more strips 22 of the synthetic grass turf 24 requires routine maintenance to maintain the levels of infill 96 at desired levels and to maintain consistent wear across the entire available matting surface. Thus, in Step 500 routine maintenance may include agitating the infill 96 to maintain the field at the desired infill consistency, measuring and replenishing infill 96 levels, leveling and compacting the infill 96 using a roller, and watering the field to aid in compaction. In addition, the markers may be shifted to prevent uneven wear the strands 80 of the synthetic grass turf 24.

While the invention has been described in terms of preferred embodiments, it will be understood, of course, that the invention is not limited thereto since modifications may be made by those skilled in the art, particularly in light of the foregoing teachings.

What is claimed is:

1. A method for forming a synthetic turf sports field comprising:

forming a level and substantially smooth subgrade;

introducing a geotextile fabric onto said subgrade;

introducing a layer of a coarse aggregate material onto said geotextile fabric, said layer having a first thickness;

introducing a plurality of first perforated drains within a portion of said coarse aggregate grade, such that said pair of perforated drains overlie said geotextile fabric and said subgrade;

fluidically coupling a plurality of drain tiles to each of said plurality of first perforated drains, each of said plurality of drain tiles separated by a first distance;

introducing a plurality of secondary perforated drains to said coarse aggregate layer, said plurality of secondary perforated drains disposed entirely above said plurality of first perforated drains, said plurality of secondary perforated drains not fluidly coupled to said plurality of drain tiles;

introducing a layer of a fine aggregate material onto said coarse aggregate material;

grading and leveling said layer of fine aggregate material to a minimum 95 percent proctor;

introducing at least one strip of a synthetic grass material onto said fine aggregate material, each of said at least one strip having a pair of lengthwise edges and a pair of widthwise edges, each of said lengthwise edges being substantially parallel with respect to each other and substantially perpendicular to each of said widthwise edges, said lengthwise edges being longer than said widthwise edges, said synthetic grass material comprising a plurality of layers of a backing material, a polypropylene mesh backing material coupled to a topmost layer of said plurality of layers of said backing material, a plurality of fibrillated synthetic grass strands tufted through said plurality of layers of said backing material and said polypropylene mesh backing material such that said ends of said plurality of fibrillated strands extend above said polypropylene mesh backing material at a first height, and a secondary coating coated to a bottommost one of said plurality of layers of said backing material such that a tufted portion of said plurality of fibrillated synthetic grass strands is contained between said secondary coating and said bottommost one of said plurality of layers of said backing material;

fibrillating and standing up said plurality of fibrillated strands on top of said polypropylene mesh backing material, wherein said fibrillated strands therein form a plurality of individual blades;

cleaning said plurality of individual blades using a lawn sweeper;

introducing a layer of infill onto said strip of said synthetic grass material to a second thickness, wherein said second thickness is less than said first height; and substantially leveling said layer of infill on said strip.

2. The method of claim 1, wherein said infill layer comprises a plurality of diatomaceous earth particles and a plurality of cryogenically or ambiently ground rubber particles.

3. The synthetic turf layer of claim 2, wherein said plurality of diatomaceous earth particles comprise between 2.5 and 5.0 weight percent of said infill layer.

4. The method of claim 1, wherein said plurality of layers of said backing material comprises:

a first woven layer;

a second woven layer bonded to said first woven layer; and a third woven layer coupled to said second woven layer.

5. The method of claim 4, wherein said first woven layer comprises a woven polypropylene/polyethylene layer having a construction polypropylene warp fiber of 94 threads per 10 cm and a construction polyethylene weft fiber of 63 threads per 10 cm.

6. The method of claim 4, wherein said third woven layer comprises a woven polypropylene/polyethylene layer having a construction polypropylene warp fiber of 94 threads per 10 cm and a construction polyethylene weft fiber of 63 threads per 10 cm.

7. The method of claim 5, wherein said third woven layer comprises a woven polypropylene/polyethylene layer having a construction polypropylene warp fiber of 94 threads per 10 cm and a construction polyethylene weft fiber of 63 threads per 10 cm.

8. The method of claim 1 further comprising coupling said at least one strip to a polywood fastener.

9. The method of claim 1 further comprising:

coupling a first strip to an adjacent strip, wherein said at least one strip comprises at least two strips.

10. The method of claim 9, wherein said first strip has a with-the-grain strand orientation and wherein said adjacent strip has an against the grain strand orientation.

11. The method of claim 10, wherein coupling said first strip to said adjacent strip comprises:

rolling up a first edge of said first strip away from said adjacent strip and away from said fine aggregate layer;

rolling up a adjacent edge of said adjacent strip away from said first strip and said fine aggregate layer, wherein an opening is thus formed between said first edge and said adjacent edge extending downward to said fine aggregate layer;

introducing a seam layer onto said fine aggregate layer within said opening;

introducing an adhesive to said top surface of said layer; and unrolling said first strip and said adjacent strip onto said adhesive such that said first edge and said adjacent edge substantially abut, said adhesive adhering said top surface of said seam layer to said polypropylene mesh layer of said first strip and said second strip.

12. The method of claim 1 further comprising inlaying a feature within said at least one strip.

13. The method of claim 12, wherein inlaying a feature comprises:

aligning a stencil onto said at least one strip;

cutting a section of said at least one strip within said stencil, therein leaving a section edge within said at least one strip;

removing said section, therein leaving an opening within said at least one strip extending to said fine aggregate layer bordered by a section edge of said at least one strip;

rolling back said section edge;

introducing a seam layer onto said fine aggregate layer with said opening;

introducing a layer of adhesive on a top surface of said seam layer;

rolling back said section edge over a portion of said top surface; and introducing a colored section of said synthetic grass material within said opening, said colored section of said synthetic grass material corresponding in size to said removed section and substantially abutting said section edge.

14. The method of claim 1 further comprising stenciling a feature onto a section of said strip.

15. The method of claim 14, wherein stenciling a feature comprises:

aligning a stencil onto said at least one strip; and painting a section of said at least one strip within said stencil.

16. The method of claim 1, wherein said layer of infill comprises a layer of cryogenically ground vulcanized rubber particles having an average sieve of between approximately 8 and 30.

17. The method of claim 1, wherein said layer of infill comprises a layer of cryogenically ground vulcanized rubber particles having an average sieve of between approximately 10 and 15.

18. The method of claim 1, wherein said first height is between approximately 0.5 and 3.5 inches.

19. The method of claim 1, wherein said first height is between approximately 2.5 and 3.5 inches and wherein said second thickness is between approximately 1.75 and 2.5 inches.

20. The method of claim 19, wherein said infill has a density of about 3.5 pounds per square foot.

21. The method of claim 19, wherein said infill layer comprises a plurality of diatomaceous earth particles and a plurality of cryogenically ground vulcanized rubber particles having an average sieve of between approximately 8 and 30.

22. The method of claim 21, wherein said plurality of diatomaceous earth particle comprises between about 2.5 and 5 weight percent of said infill layer.

23. The method of claim 1, wherein said plurality of first perforated drains are laid perpendicular to said lengthwise edges, wherein one of said plurality of first perforated drains is located at a position near and below one of said widthwise edges and another of said plurality of first perforated drains is located near and below the other of said pair of widthwise edge.

24. The method of claim 1, wherein said plurality of secondary perforated drains are laid perpendicular to said lengthwise edges, wherein one of said plurality of secondary perforated drains is located at a position near and below one of said widthwise edges and another of said plurality of secondary drains is located near and below the other of said plurality of widthwise edges.

25. The method of claim 23, wherein said plurality of drain tiles are fluidically coupled to each of said first perforated drains and extend substantially parallel to said lengthwise edges of said at least one strip.

26. The method of claim 25, wherein said first distance is approximately between about 20 and 30 feet.

27. The method of claim 23, wherein said plurality of first perforated drains are fluidically coupled to each of said perforated drain tiles and extend substantially parallel to said lengthwise edges of said at least one strip, each of said perforated drain tiles laid in a herringbone pattern.

28. The method of claim 27, wherein said first distance is approximately between about 20 and 30 feet.

29. The method of claim 1, wherein said fine aggregate layer slopes ½ percent downward from a center portion towards each of said edges defined by said widthwise edges of said at least one strips.

30. The method of claim 1, wherein fibrillating and standing up said plurality of fibrillated strands comprises:

introducing a mechanical brush onto on top of said strip; and moving said mechanical brush in an against the grain direction against said plurality of fibrillated strands.

31. The method of claim 19, wherein introducing a layer of infill onto said strip comprises:

introducing a first portion of said infill layer to said strip using a top dresser;

brushing said first portion of infill layer in a first direction using a mechanical brush, said first direction corresponding to an against the grain orientation of said plurality of fibrillated strands;

brushing said first portion with a grooming brush;

introducing a second portion of said infill layer to said first portion using said top dresser; and leveling said second portion onto said first portion, said second portion and said first portion such that said infill has a second thickness, wherein said second thickness is less than said first height.

32. A method for forming a synthetic turf surface, the method comprising:

forming a level and substantially smooth subgrade;

introducing a geotextile fabric onto said subgrade;

introducing a layer of a coarse aggregate material onto said geotextile fabric, said layer having a first thickness;

introducing a plurality of first perforated drains within a portion of said coarse aggregate grade, such that said plurality of first perforated drains overlie said geotextile fabric and said subgrade;

coupling a plurality of drain tiles to each of said plurality of first perforated drains, each of said plurality of drain tiles separated by a first distance;

introducing a plurality of secondary perforated drains to said coarse aggregate layer, said plurality of secondary perforated drains disposed entirely above said plurality of first perforated drains, said plurality of secondary perforated drains not fluidly coupled to said plurality of drain tiles;

introducing a layer of a fine aggregate material onto said coarse aggregate material;

grading and leveling said layer of fine aggregate material to a minimum 95 percent proctor;

introducing at least one strip of a synthetic grass material onto said fine aggregate material, each of said at least one strip having a pair of lengthwise edges and a pair of widthwise edges, each of said lengthwise edges being substantially parallel with respect to each other and substantially perpendicular to each of said widthwise edges, said lengthwise edges being longer than said widthwise edges, said synthetic grass material comprising a plurality of layers of a backing material, a polypropylene mesh backing material coupled to a topmost layer of said plurality of layers of said backing material, a plurality of fibrillated synthetic grass strands tufted through said plurality of layers of said backing material and said polypropylene mesh backing material such that said ends of said plurality of fibrillated strands extend above said optional polypropylene mesh backing material at a first height, and a secondary coating coated to a bottommost one of said plurality of layers of said backing material such that a tufted portion of said plurality of fibrillated synthetic grass strands is contained between said secondary coating and said bottommost one of said plurality of layers of said backing material;

fibrillating and standing up said plurality of fibrillated strands on top of said optional polypropylene mesh backing material, wherein said fibrillated strands therein form a plurality of individual blades;

introducing a layer of infill onto said strip of said synthetic grass material to a second thickness, wherein said second thickness is less than said first height, said layer of infill comprises comprising a plurality of ground rubber particles and a plurality of sand particles; and substantially leveling said layer of infill on said strip.

33. The method of claim 32, wherein said first height is about ½ inch and wherein the thickness of said infill is approximately ⅓ inch.

34. The method of claim 33, wherein introducing a layer of infill onto said strip of said synthetic grass material to a second thickness comprises:

introducing a plurality of sand particles onto said at least one strip using a top dresser; and introducing a plurality of rubber particles onto said plurality of sand particles to form the infill, wherein said plurality of ground rubber particles comprises approximately 60 percent of the total weight of said infill.

35. The method of claim 34, wherein said infill has a density of about 5 pounds per square foot.

36. The method of claim 32, wherein said plurality of ground rubber particles has an average mesh size of about 16 to 25 mesh.

37. The method of claim 32, wherein said plurality of ground rubber particles comprises a plurality of cryogenically ground rubber particles.

38. The method of claim 32, wherein said plurality of ground rubber particles comprises a plurality of ambiently ground rubber particles.

39. The method of claim 32, wherein said plurality of ground rubber particles comprises a mixture of cryogenically ground rubber particles and ambiently ground rubber particles.

40. The method of claim 32, wherein said plurality of sand particles has an average sieve size of about 25.

41. The method of claim 32, wherein said infill layer further comprises a plurality of diatomaceous earth particles.

42. The method of claim 41, wherein said plurality of diatomaceous earth particle comprises between about 2.5 and 5 weight percent of said infill layer.

43. The method of claim 32, wherein said plurality of layers of said backing material comprises:

a first woven layer;

a second woven layer bonded to said first woven layer; and a third woven layer coupled to said second woven layer.

44. The method of claim 43, wherein said first woven layer comprises a woven polypropylene/polyethylene layer having a construction polypropylene warp fiber of 94 threads per 10 cm and a construction polyethylene weft fiber of 63 threads per 10 cm.

45. The method of claim 43, wherein said third woven layer comprises a woven polypropylene/polyethylene layer having a construction polypropylene warp fiber of 94 threads per 10 cm and a construction polyethylene weft fiber of 63 threads per 10 cm.

46. The method of claim 44, wherein said third woven layer comprises a woven polypropylene/polyethylene layer having a construction polypropylene warp fiber of 94 threads per 10 cm and a construction polyethylene weft fiber of 63 threads per 10 cm.

* * * * *